US007216785B1

(12) United States Patent
Meyer et al.

(10) Patent No.: US 7,216,785 B1
(45) Date of Patent: May 15, 2007

(54) SAND AND DIVOT REPLACER WITH QUICK RELEASE TOP

(76) Inventors: John W. Meyer, 53 Andy Creek La., Cascade, MT (US) 59241; Doug Jacobe, 53 Andy Creek La., Cascade, MT (US) 59241

( * ) Notice: Subject to any disclaimer, the term of this patent is extended or adjusted under 35 U.S.C. 154(b) by 0 days.

(21) Appl. No.: 11/388,197

(22) Filed: Mar. 23, 2006

Related U.S. Application Data

(63) Continuation-in-part of application No. 10/789,886, filed on Feb. 27, 2004, now Pat. No. 7,156,269, and a continuation-in-part of application No. 09/943,074, filed on Aug. 29, 2001, now abandoned.

(60) Provisional application No. 60/664,672, filed on Mar. 23, 2005, provisional application No. 60/230,393, filed on Sep. 6, 2000.

(51) Int. Cl.
*B65D 5/72* (2006.01)

(52) U.S. Cl. ..... 222/568; 222/105; 222/148.4; 222/181.2; 222/465.1; 222/566; 222/575

(58) Field of Classification Search ..... 222/566–568, 222/173, 181.2, 196, 196.1, 575, 180, 610, 222/475, 465.1, 183, 105, 153.01, 153.14; 224/148.2, 274, 148.4, 401; 206/217, 477, 206/564; 248/310, 318, 311.2, 205.1
See application file for complete search history.

(56) References Cited

U.S. PATENT DOCUMENTS

| | | | | |
|---|---|---|---|---|
| 3,058,633 | A | 10/1962 | Muhlhoff | |
| 3,338,482 | A * | 8/1967 | Jordan | 222/479 |
| 5,279,450 | A | 1/1994 | Witt, Jr. | |
| 5,772,069 | A | 6/1998 | Price | |
| 6,739,486 | B2 * | 5/2004 | Winkler | 222/608 |

OTHER PUBLICATIONS

"Santiago" Sand bottle manufactured by Missouri River Plastics, P.O. Box 645 Cascade, Montana 59421, (photograph attached).

* cited by examiner

*Primary Examiner*—Frederick C. Nicolas
(74) *Attorney, Agent, or Firm*—Richard C. Conover

(57) ABSTRACT

A sand and seed divot replacer including a pour spout having an inwardly extending lip formed on the inner surface of the pour spout at an end distal from the pouring end. An open top bottle is provided including an outwardly extending circumferentially positioned band located on the exterior surface of the bottle adjacent the open top. The spout constructed of a resilient material and the distal end sized to receive the band of the bottle with the lip in latching engagement with the band of the bottle. The bottom wall of the bottle including an indented portion. A holder is provided having a main body open at the top and closed at the bottom with a bottom wall. The holder is sized for receiving the bottle and spout. The bottom wall of the holder includes an indented portion sized for nesting in the indented portion of the bottle.

2 Claims, 5 Drawing Sheets

SAND AND DIVOT REPLACER WITH QUICK RELEASE TOP

This application claims the benefit of provisional application Ser. No. 60/664,672 filed Mar. 23, 2005 and continuation-in-part application Ser. No. 10/789,886 filed Feb. 27, 2004 now U.S. Pat. No. 7,156,269, of a utility application Ser. No. 09/943,074 filed Aug. 29, 2001 (now abandoned) which claimed the benefit of provisional application Ser. No. 60/230,393 filed Sep. 6, 2000.

BACKGROUND OF THE INVENTION

The present invention relates to a sand and seed divot replacer for use by golfers.

When golfing, golfers often form divots in the fairways when making golf shots. Many golf courses request golfers to replace the divots with a sand and seed mixture allowing new grass to form.

Known sand and seed divot replacers include a bottle with spout. The bottle is provided with a threadably removable bottom wall for closing the bottom of the bottle. In order to fill these bottles, the bottle and spout are inverted and the threaded bottom wall removed. The seed and sand mixture is then poured into the inverted bottle. With these devices, however, the spout needs to be closed when filling the bottle with the sand and seed mixture. This can be inconvenient and may cause loss of seed and sand mixture during the filling process. Further, the known sand and divot bottle kits include holders for holding the bottle. But with the known holders, the bottle is held loosely in the holder causing the bottle to rattle when a golf cart, to which the holder is mounted, is driven around the golf course.

SUMMARY OF INVENTION

With the present invention, many of the problems of the known sand bottle kits are resolved. The spout forms a portion of a cap for the bottle. The cap includes a quick release mechanism for securing the cap to the bottle. When it is desired to fill the bottle, the cap is removed with the quick release mechanism and the bottle filled. There is no loss of sand and seed, and there is no need to close the spout when filling the bottle. Further, a holder is provided which seats the bottle in the holder to prevent rattling.

BRIEF DESCRIPTION OF THE DRAWINGS

In order that the invention may be clearly understood and readily carried into effect, a preferred embodiment of the invention will now be described, by way of example only, with reference to the accompanying photographs and drawings wherein.

DESCRIPTION OF PREFERRED EMBODIMENTS

Figure 2:
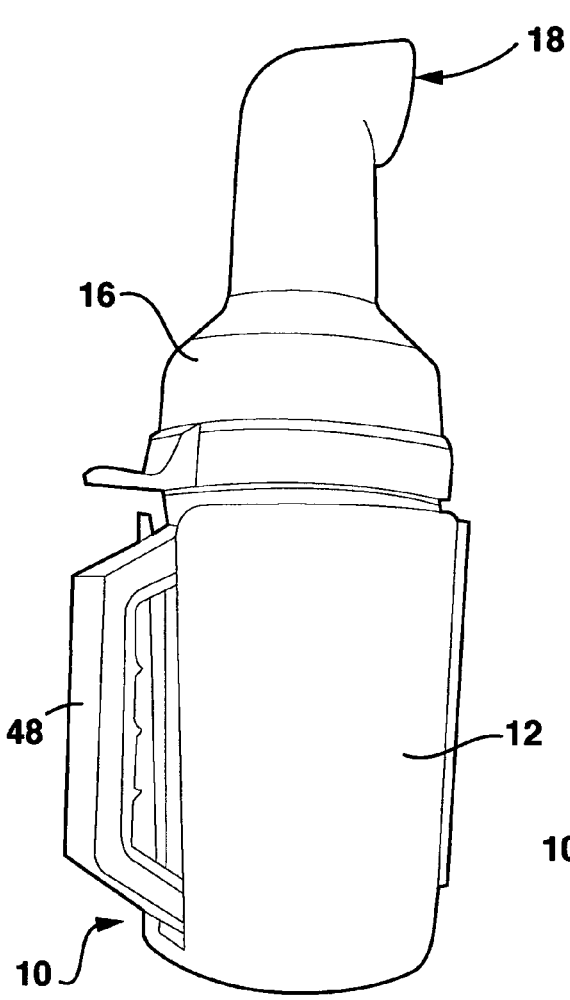
FIG. 2 is a rear elevational view of the invention shown in FIG. 13.
Figure 1:
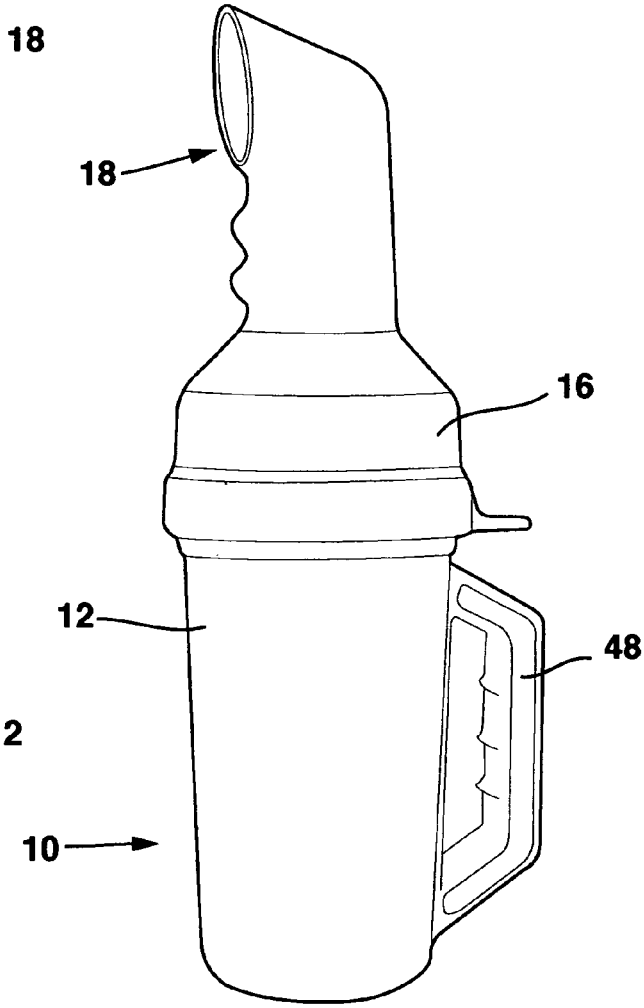
FIG. 1 is a front elevational view of a sand and divot replacer according to the present invention.
Figure 3:
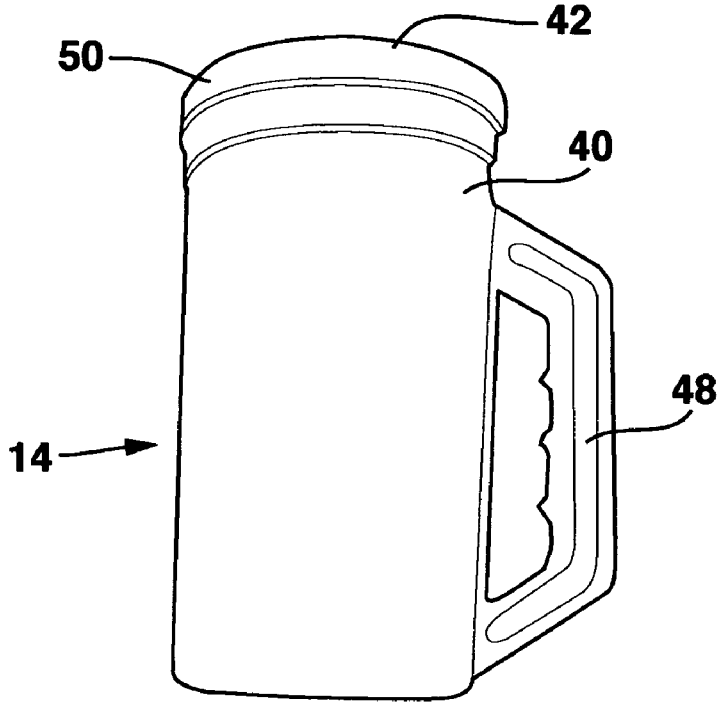
FIG. 3 is a front elevational view of a bottle used with the present invention.
Figure 4:
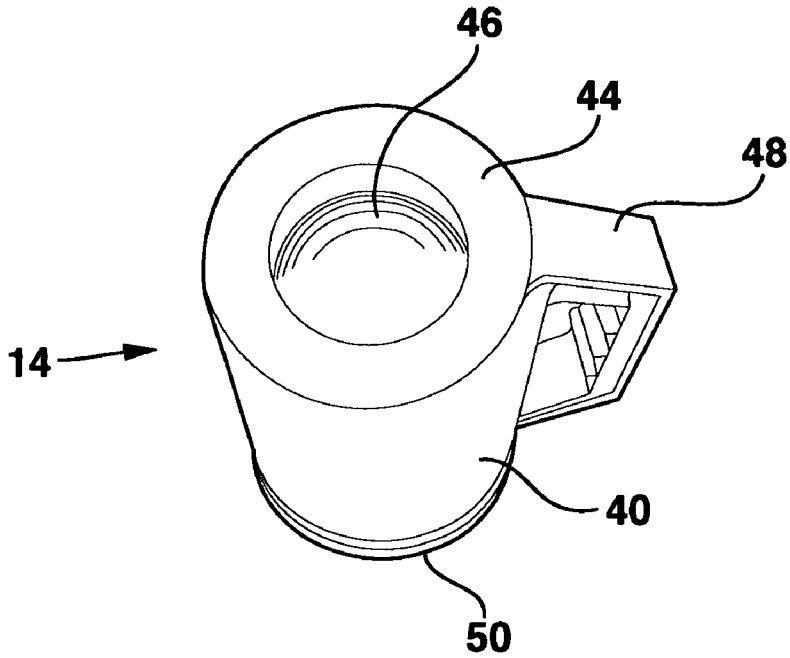
FIG. 4 is a bottom perspective view of the bottle shown in FIG. 3.

A sand and seed divot replacer 10 is shown in FIGS. 1 and 2. The and seed divot replacer 10 includes a bottle holder 12 for holding an open top bottle 14 as shown in FIGS. 3 and 4. The bottle 14 is provided with a cap 16 for covering the open top of the bottle 14. The cap 16 includes a pouring spout 18.

Figure 5:
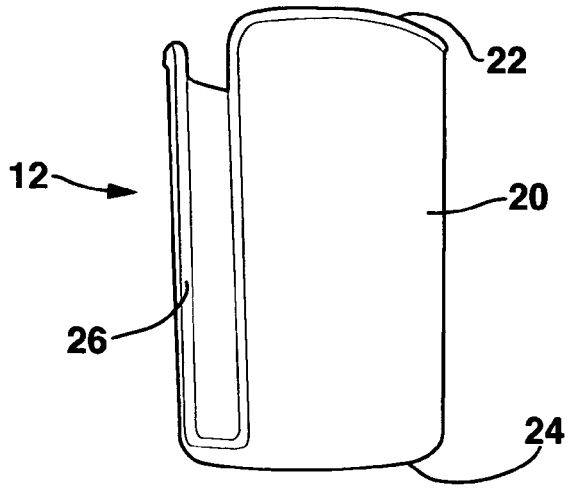
FIG. 5 is a front elevational view of a bottle holder used with the present invention.
Figure 6:
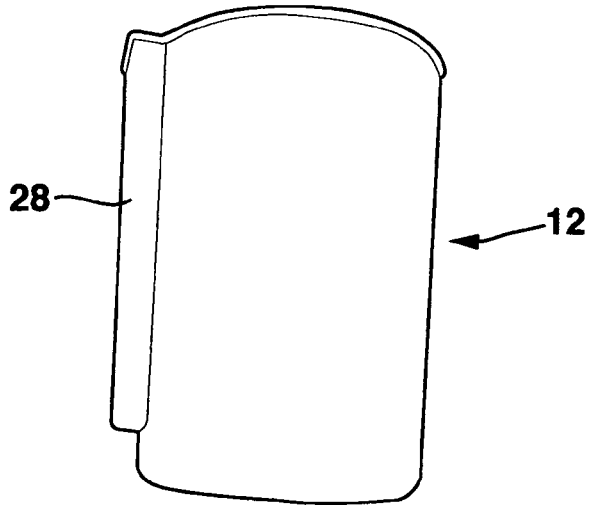
FIG. 6 is a rear elevational view of the bottle holder shown in FIG. 4.
Figure 7:
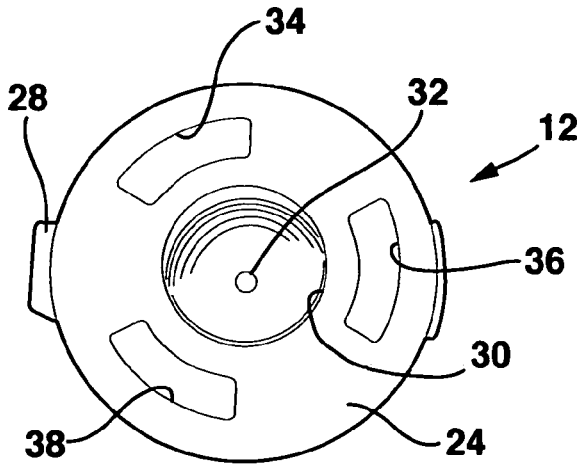
FIG. 7 is a bottom view of the bottle holder shown in FIG. 6.
Figure 8:
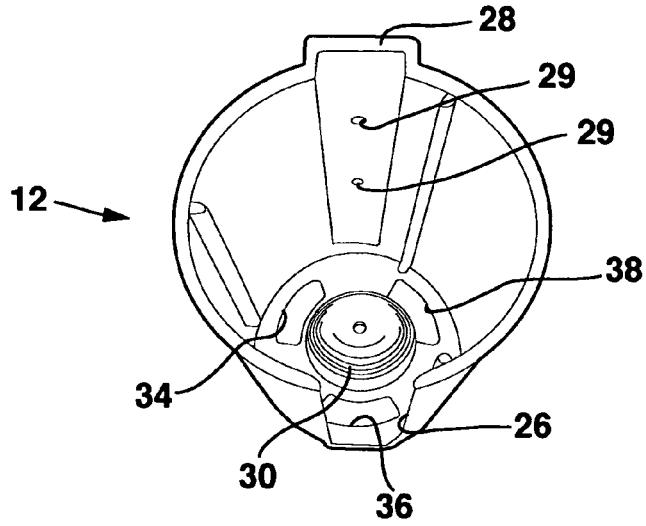
FIG. 8 is a top view of the bottle holder shown in FIG. 6.

The bottle holder 12 is shown in FIGS. 5–8. The bottle holder 12 includes a cylindrical shell 20 having an open top 22 and a bottom wall 24. The bottle holder 12 is further provided with a slot 26 extending from the open top 22 to a position adjacent the bottom wall 24 as shown in FIG. 5. A mounting bracket 28 is formed on the shell 20 as shown in FIGS. 6–8. Screw holes 29 are provided in bracket 28 which, if desired, can be used to mount the holder 12 to an appropriate surface of a golf cart, for example.

The bottom wall 24 of the bottle holder 12 includes a hemispherical indented portion 30 extending toward the interior of the bottle holder 12. An axial hole 32 is provided in indented portion 30. The bottom wall 24 is further provided with three cut outs 34, 36 and 38 as shown in FIG. 7.

The bottle 14 is shown in FIGS. 3 and 4 and includes a hollow cylindrically shaped main body portion 40 with an open top 42 and a closed bottom end wall 44. The end wall 44 includes a concave hemispherical indented portion 46 extending toward the interior of the bottle 14. The indented portion 46 is sized to receive the indented portion 30 of the bottle holder 12 when the bottle 14 is placed in the bottle holder 12. A handle 48 is mounted to the body 40 of the bottle 14 as shown in FIGS. 3 and 4 and is used to lift the bottle 14 from the bottle holder 12. The body 40 further includes an enlarged portion 50 which extends as a band around the body 40 adjacent the open top 42 as shown in FIGS. 3 and 4.

Figure 9:
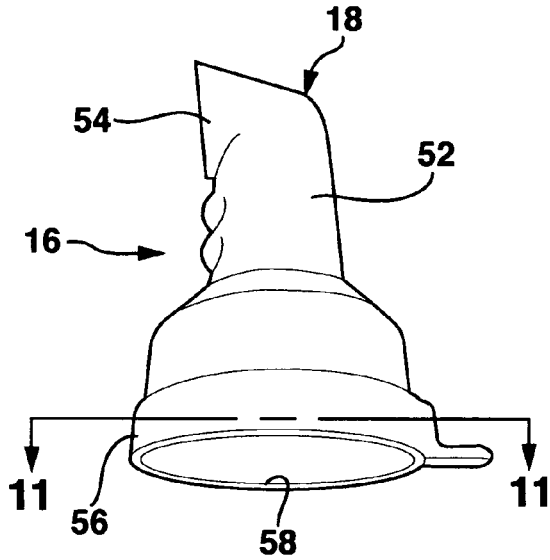
FIG. 9 is an elevational perspective view of a cap used with the present invention.
Figure 10:
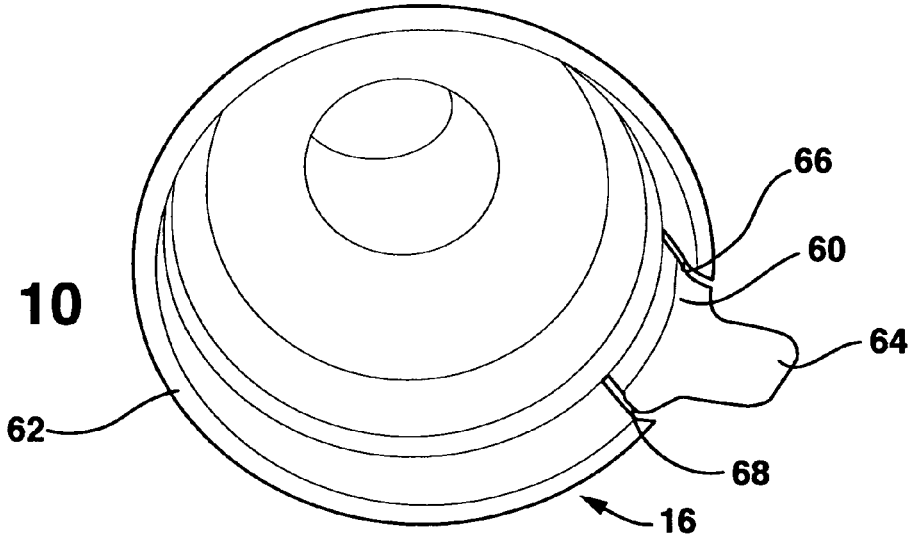
FIG. 10 is a bottom perspective view of the cap shown in FIG. 9.
Figure 11:
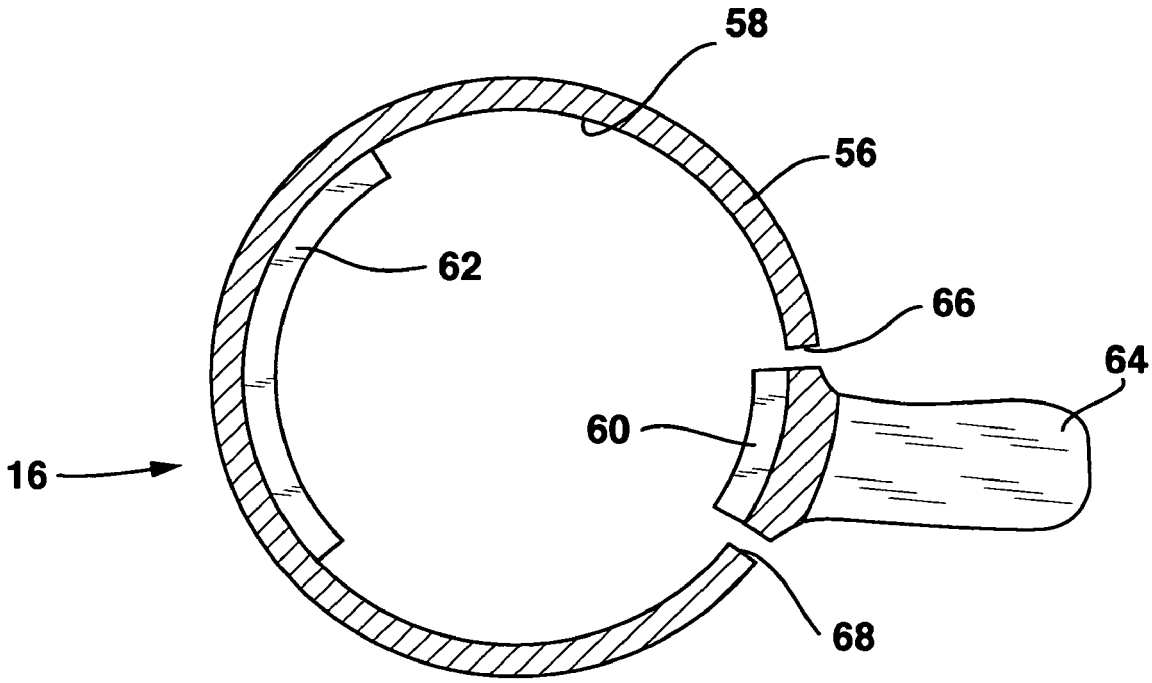
FIG. 11 is a cross sectional view taken along the line 11—11 in FIG. 9.

The cap 16 is shown in FIGS. 9–11. In a preferred embodiment the cap 16 is constructed of a resilient plastic material. The spout 18 includes a main spout portion 52 and a bent pour spout 54 integrally formed with the main spout portion 52 and extending in a direction substantially perpendicular to a longitudinal axis of the main spout portion 52. At the end of the main spout portion 52, an enlarged portion 56 is provided adjacent an open end 58 of the cap 16. The enlarged portion 56 is sized to fit over the enlarged band 50 provided at the top of the bottle 14.

The enlarged portion 56 is also provided with a pair of interiorly extending lips 60 and 62. When the cap 16 is fitted over the enlarged portion 50 of the bottle 14 the lips 60 and 62 engage the bottom edge of the band 50 thereby securing the cap 16 to the bottle 14.

In order to release the cap 16 from the bottle 14 so that the bottle may be filled with sand and seed, a tab 64 is mounted to the enlarged portion 56. This tab 64 is integrally connected with the lip 60. On either side of the lip 60 a pair of notches 66 and 68 are formed in the enlarged portion 56 so that when the tab 64 is bent upwardly toward the bent spout

54 the lip 60 is disengaged from the band 50 of the bottle 14. In this manner, the cap 16 can be removed from the bottle 14.

In operation, the bottle 14 is filled with seed and sand after first removing the cap 16 from the bottle 14 by bending the tab 64 upwardly and lifting the cap 16 off the bottle 14. After the bottle 14 is filled, the cap 16 is positioned over the bottle 14 and pushed downwardly whereby the lips 60 and 62 snap onto the band 50 of the bottle 14. The bottle 14 with the spout 18 is then placed in bottle holder 12 for storage.

With the indented portion 30 of the holder nesting in the indented portion of 46 of the bottle, the bottle 14 is prevented from rattling when the golf cart is driven around the golf course.

When it is desired to use bottle 14 to fill a divot, the bottle 14 with the spout 18 is removed from holder 12 with the handle 48 and sand and seed poured through bent spout 54 into the divot to be repaired. When this is accomplished, the bottle 14 may again be placed in the bottle holder 12 for storage.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims:

We claim:

1. A sand and seed divot replacer comprising:

a spout including an elongate, hollow main body portion having a hollow bent pour spout integrally formed at a first end thereof and an inwardly extending lip portion integrally formed on an interior surface of the main body portion adjacent a second end thereof;

a bottle including a main body portion with an open top and closed at the bottom with a bottom wall;

the bottle further including an outwardly extending, circumferentially positioned band portion located on an exterior surface of the main body portion adjacent the open top;

the spout constructed of a resilient material and the second end of the spout sized to receive the band portion of the bottle with the lip portion in latching engagement with an underside of the band portion of the bottle;

a tab means attached to the spout adjacent the second end thereof for bending the spout to release the lip portion from the band;

a hollow holder means having a main body portion open at the top and closed at the bottom with a bottom wall for holding the bottle and spout;

the holder means sized to receive the bottle within the interior thereof;

the holder means further including a mounting bracket means integrally formed on the exterior surface of the main body portion of the holder means for mounting the holder to a support structure;

the bottle having a cylindrical shape with a longitudinal axis, and wherein the bottom wall of the bottle includes a concave indented portion extending inwardly and wherein the bottom wall of the holder includes a plurality of cut-outs spaced around the periphery of the bottom wall and further includes a convex indented portion extending inwardly and positioned and sized for nesting in the indented portion of the bottle when the bottle is positioned within the holder;

the indented portion of the bottle and the indented portion of the holder having a corresponding hemispherical shape;

the main body portion of the spout extending in a direction generally coaxial with the longitudinal axis of the bottle; and the bent pour spout extending in a direction generally perpendicular to the longitudinal axis of the bottle and having a length less than one-third a length of the main body portion.

2. The sand and seed divot replacer according to claim 1 wherein the bottle further includes a handle mounted to the exterior surface of the bottle and wherein the holder further includes a slot extending from the open top to a position adjacent the bottom wall and sized to receive the handle.

* * * * *